US006515422B1

(12) United States Patent
Honda

(10) Patent No.: US 6,515,422 B1
(45) Date of Patent: Feb. 4, 2003

(54) PHOTO CATALYZER AND DISCHARGE LAMP HAVING A PHOTO CATALYTIC LAYER

(75) Inventor: Hisashi Honda, Yokosuka (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 1215 days.

(21) Appl. No.: 08/649,487

(22) Filed: May 17, 1996

(51) Int. Cl.[7] ..... H01J 61/35
(52) U.S. Cl. ..... 313/635; 313/489; 422/121
(58) Field of Search ..... 313/635, 112, 313/113, 489, 580; 502/350, 325; 422/120, 5, 122, 121

(56) References Cited

U.S. PATENT DOCUMENTS 4,634,919 A * 1/1987 Yuge et al. ..... 313/113
4,692,662 A * 9/1987 Wada et al. ..... 313/493
5,113,109 A * 5/1992 Kawakatsu et al. ..... 313/112
5,650,126 A * 7/1997 Taoda et al. ..... 422/122

* cited by examiner

*Primary Examiner*—Jay Patidar
(74) *Attorney, Agent, or Firm*—Pillsbury Winthrop LLP

(57) ABSTRACT

A photo catalyzer includes a light-transmitting substrate and a catalytic layer provided on the substrate. The catalytic layer substantially includes anatase form of titanium oxide and has a thickness of 0.01 to 0.3 microns. The photocatalyzer can be part of a lamp or lighting fixture arrangement.

2 Claims, 4 Drawing Sheets

PHOTO CATALYZER AND DISCHARGE LAMP HAVING A PHOTO CATALYTIC LAYER

BACKGROUND OF THE INVENTION

1. Field of the Invention

The present invention relates to a photo catalyzer and discharge lamp having a photo catalytic layer.

2. Description of the Related Art

Recently, photo catalytic materials, which are activated by receiving ultraviolet rays, have been researched for various purposes.

One known photo catalytic material is titanium oxide. In particular, titanium oxide having anatase form is known to be a good catalytic material. Titanium oxide is a semiconductor having a forbidden band width of about 3.0 eV. Electron and hole mobilization occur in the titanium oxide when it absorbs ultraviolet rays having sufficient energy to cause an excited state. The energy is equivalent to a wavelength of about 410 nm. Radiation generated by conventional lamps, such as fluorescent lamps, incandescent lamps and high intensity discharge lamps include such ultraviolet rays which excite the titanium oxide. When energized, "holes" move on a surface of the titanium oxide. The holes attract electrons of a material in contact with the surface to oxidize it. The holes extract electrons from the material which correspond to the energy of the forbidden band width. The titanium oxide can be used as deodorizer and also used as a catalyzer to decompose a source of bad smell, such as acetaldehyde, methy-methylation-butane, hydrogen-sulfide ammonia and so on. It can also be utilized as a sterilizer in sewage disposal plants, hospitals and other places.

Japanese Laid Open Patent Application No. 1-169866 discloses a catalyzer having a layer of titanium oxide coated on the outer surface of an ultraviolet lamp. The bulb of the lamp is made of quartz glass so as to directly transmit a resonance line of mercury at 254 nm plus small additions of other ultraviolet lines such as 185 nm. The titanium oxide layer coated on the lamp operates as a photo catalyzer due to a catalytic reaction that occurs when the titanium oxide layer receives ultraviolet radiation emitted by the lamp.

Similarly, Japanese Laid Open Patent Application No. 6-304480 discloses a lamp for decomposing ethylene. The lamp is coated with a titanium oxide layer of 2 microns thickness or more.

Japanese Laid Open Patent Application No. 6-278241 discloses plate glass using for a pane. The glass plate is coated metal oxide material of several microns thickness so that the glass plate occurs a catalytic reaction when it transmits solar lays.

Japanese Laid Open Patent Application No. 7-111104 discloses a lighting fixture having a light-transparent cover coated metal oxide thereon.

However, in those prior arts, ultraviolet rays are almost all absorbed during the ultraviolet rays transmission through the titanium oxide layer. Therefore, the amount of ultraviolet rays reaching the outer surface of titanium oxide layer becomes low. As a result, it is not able to oxidize materials attached on the outer surface thereof, because there are little holes around the outer surface. Furthermore, as the transmission factor within visible light range is reduced based on the titanium oxide layer, the amount of light which transmits through the layer is reduced. Therefore, the luminous flux transmitted or radiated through the plate glass, the lighting fixture or the lamp becomes lower.

SUMMARY OF THE INVENTION

Accordingly, a primary object of the present invention is to provide a catalyzer that provides sufficient oxidation of materials in contact with a surface of the catalyzer while still providing a sufficient transmission factor.

A photo catalyzer according to the present invention has a light-transmitting substrate. A catalytic layer is provided on the substrate. The catalytic layer substantially includes anatase form of titanium oxide and has thickness of 0.01 to 0.3 microns.

Second, the present invention provides a photo catalytic apparatus including the photo catalyzer described above and a light source radiating ultraviolet radiation having a wavelength below 410 nm. The light source is provided on the other side of the substrate from the catalyzing material.

Third, the invention provides a light source having a light-transmitting envelope, means for radiating light including ultraviolet rays and a photo catalytic layer coated on an outer surface of the envelope.

Fourth, the present invention provides a lighting fixture including the light source described above and a luminaire housing the light source.

The present invention also provides a lighting apparatus including the lighting fixture described above and an operating circuit supplying electric power to the light source.

Various embodiments of the invention will be described in detail with reference to the following drawings.

BRIEF DESCRIPTION OF THE DRAWINGS

The invention will be described in more detail below in conjunction with the following drawings of which.

DETAILED DESCRIPTION OF THE PRESENTLY PREFERRED EXEMPLARY EMBODIMENT

A first embodiment of this invention will be explained with reference to FIGS. 1 to 3.

Figure 1:
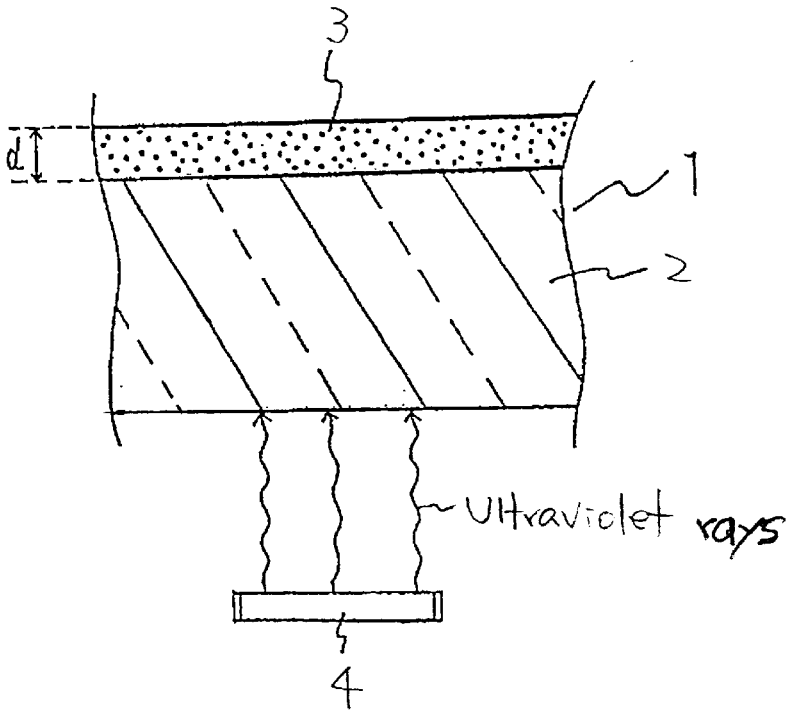
FIG. 1 is a detailed portion cross sectional and broken view of the catalyzer according to first embodiment of the present invention.

FIG. 1 shows a photo catalyzer 1. Catalyzer 1 has a substrate 2 and a photo catalytic layer 3. Substrate 2 is made from quartz glass so as to transmit ultraviolet rays in a wavelength range below 410 nm. However, other light-transmitting materials, such as soda-lime glass, borosilicate glass, optical ceramics or some equivalent thereof, may be used. Catalytic layer 3 is coated on a surface of substrate 2, which substantially includes anatase form of titanium oxide ($TiO_2$). It may be used for the catalytic materials that anatase form titanium oxide containing other materials less than 50 percent by weight of the entire weight of photo catalytic layer 3. Those materials are metal oxide or metal having catalytic reaction, such as ZnO, $WO_3$, $Fe_2O_3$, $FeTiO_3$, $SrTiO_3$, $CeO_2$, $Tb_2O_3$, MgO, $Er_2O_3$, Pt, Ag, Pd and Au. Catalytic layer 3 is preferably formed by the hydrolysis method of titan-alcholate, for instant, spray coating with a previously prepared solution of the $TiO_2$ and by firing at a temperature of about 700 degrees. The temperature is slightly lower than the brookite transformation point of $TiO_2$. The previously prepared solution is a mixture of tetraisopropylene titanatemonomer chelated by glycerol and acetylacetone, and ethyl acetate ethanol for regulating the titanium oxide alkoxide. The firing temperature is preferably selected around 700 degrees described above, because if the temperatures are around 500 and 900 degrees, the titanium oxide has a different structure of crystal from the anatase, for example, the structure tends to be amorphous and rutile, respectively. Alternatively, catalytic layer 3 can be formed by dip coating method with titania alkoxide (manufactured by NIPPON-Soda; NTi-92) and by firing for 15 minutes after drying. In the case of this dip coating, the firing temperature is selected to be between 500 and 900 degrees. The thickness (d) of catalytic layer 3 should be provided between 0.01 and 0.3 microns, preferably selected between 0.01 and 0.1 microns. Photo catalytic layer 3 can also be used as a deodorizer to decompose a source of bad smell when photo catalytic layer 3 receives ultraviolet rays having a wavelength below 410 nm emitted by a lamp 4, because the titanium oxide has a band gap energy of 3 eV which is equivalent to the above wave length.

Figure 2:
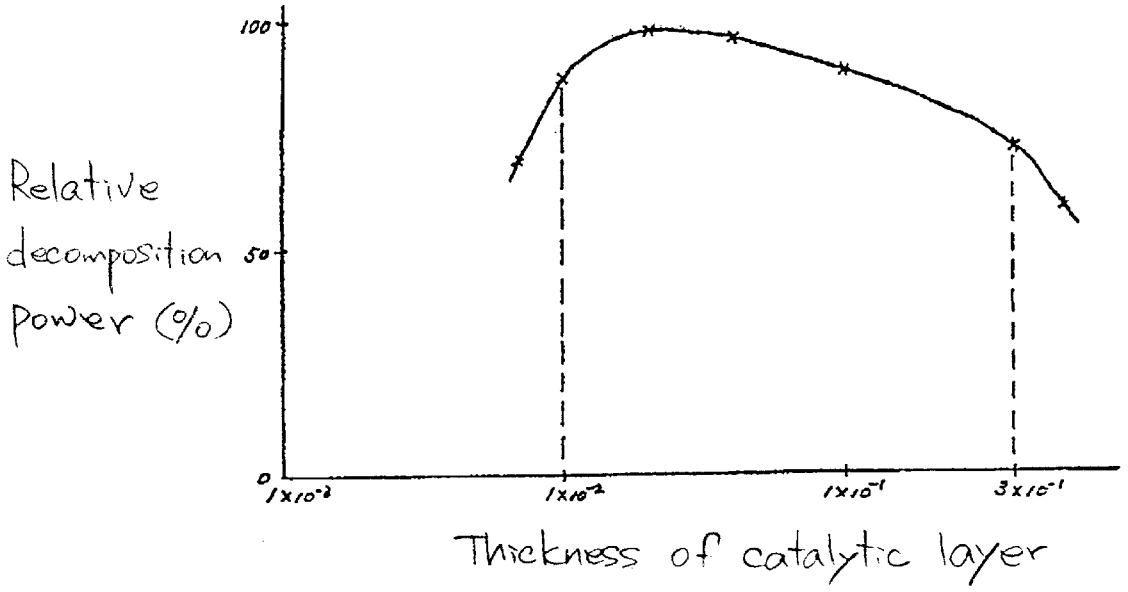
FIG. 2 is a graph showing experimental results relating a change of decomposition power of the catalyzer to the thickness of catalytic layer.

FIG. 2 shows experimental results relating a change of relative decomposition power of catalyzer 1 to the thickness (d) of catalytic layer 3 in a closed space where seven test catalyzers are operated. Each test catalyzer 1 is made identical to others except for the thickness (d) of photo catalytic layer 3. Each photo catalyzer 1, had cigarette smoke thereon so that particles of the smoke stuck thereto. The catalyzer was then illuminated by ultraviolet rays by a light source disposed on the other side of photo catalytic layer 3 as shown in FIG. 1. The decomposition power is indicated by the divided differences (T2-T1) between the visible light transmission factor in 550 nm of test catalyzer before and after each test catalyzer operates for 10 hours. Therefore, the divided difference becomes higher as catalyzer 1 has strong decomposition power, since the factor T2 (after the catalyzer operates) becomes lower compared with the initial factor T1 (before the catalyzer operates) due to the decomposition of the smoke.

The decomposition power rapidly drops when the thickness (d) of catalytic layer 3 is less than 0.01 microns, because the ultraviolet rays absorption of catalytic layer 3 is reduced. Reversely, the power also rapidly drops when the thickness (d) exceeds 0.3 microns as the amount of ultraviolet rays approached to the surface of catalytic layer 3 is reduced. Accordingly, the thickness (d) of photo catalytic layer 3 should be selected to be within 0.01 to 0.3 microns mentioned above in order to provide efficiently decomposition power. Catalyzer 1 also has a good transmission factor in the range of visible wavelengths when the catalytic layer 3 has the thickness (d) mentioned above. Furthermore, the thickness (d) is preferably selected to be less than 0.1 microns.

Figure 3:
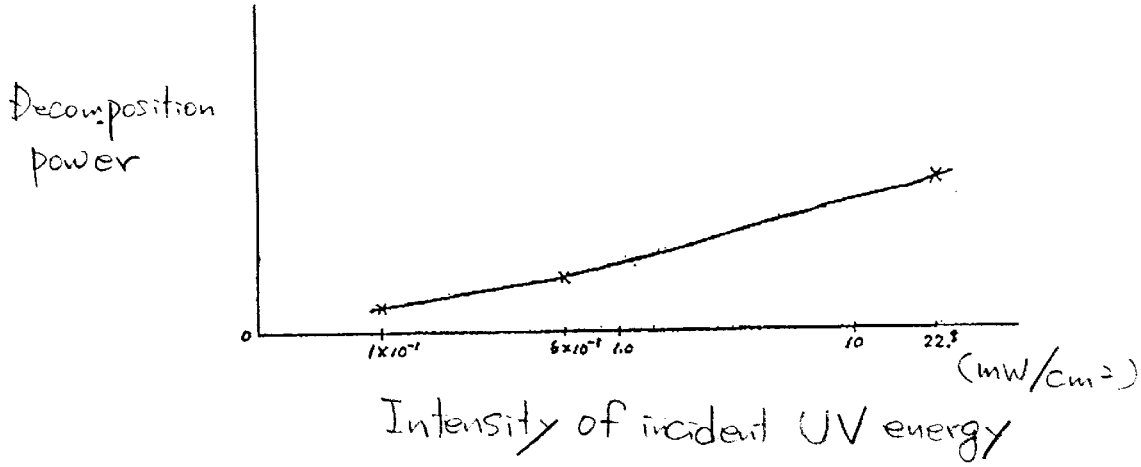
FIG. 3 is a graph showing experimental results relating a change of decomposition power of the catalyzer to the intensity of ultraviolet radiant energy.

FIG. 3 shows experimental results indicating change of the decomposition power as a function of intensity of incident ultraviolet radiant energy on photo catalytic layer 3. The decomposition power increases according to the incident ultraviolet rays becomes stronger. In order to strengthen the decomposition power, it is an advantage to use a light source having strong ultraviolet radiant energy. For that purpose, it is efficient to use a light source which enables to provide catalyzer 1 the incident ultraviolet rays having at least 0.01 $mW/cm^2$ intensity.

Other embodiments in accordance with the present invention will now be explained. Like reference characters designate identical or corresponding elements to those above-disclosed with respect to the first embodiment. The construction and operation of the following embodiment are substantially the same as those of the first embodiment and, therefore, detailed explanations of operations are not provided.

Figure 4:
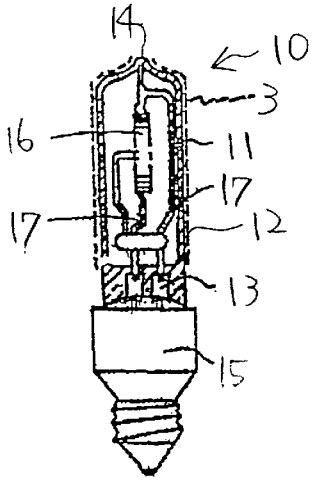
FIG. 4 is an elevation partly in section of the incandescent lamp according to second embodiment of the present invention.

FIG. 4 shows a single ended incandescent lamp 10 according to second embodiment of the present invention. Lamp 10 is preferably utilized for conventional spotlights and downlights. An envelope 11 of incandescent lamp 10 is continuously formed with a cylindrical portion 12 and sealed portion 13. Envelope 11 is made from silica glass so that ultraviolet rays transmit through envelope 11. Envelope 11 also includes an exhaust tube 14 which is used for pumping air from envelope 11 and refilling envelope 11 with a mixture of an inert gas and a halogen gas. Sealed portion 13 is formed at opposite end to exhaust tube 14, where is attached a base 15. A filament 16 is provided along the central axis of envelope 11 in a space surrounded by cylindrical portion 12, so as to span lead wires 17 passed through sealed portion 13.

A photo catalytic layer 3 shown as a dot line is coated on an outer surface of envelope 11 so as to have a thickness of 0.1 microns, which is anatase form of titanium oxide ($TiO_2$). Catalytic layer 3 is formed by a dip coating method. Envelope 11 is immersed in a previously prepared solution and fired at a temperature of 700 degree for 5 minutes after drying. The previously prepared solution is a medium of tetraisopropylene-titanate monomer in organic solvent, which contains tetraisopropylene-titanate within 2 to 10 weight percent and has a viscosity of about 2.0 cps. An optical interference layer (not shown), which includes a plurality of high refractive index layers made of a metal oxide substance, is preferably arranged between catalytic layer 3 and an outer surface of envelope 11 to reflect infrared rays toward to filament 16 in accordance with light interference.

Ultraviolet rays radiated by filament 16 almost transmits envelope 11. Photo catalytic layer 3 coated on an outer surface of envelope 11 absorbs the ultraviolet rays. Therefore, materials attached on the surface of photo catalytic layer 3, such as sulfur compounds, nitrogen compounds and aldehydes and so on, are sufficiently decomposed due to a catalysis reaction of photo catalytic layer 3. Therefore, lamp 10 is able to deodorize such a source of bad smell. Lamp 10 also has a disinfecting action against various germs and a purification effect. Furthermore, it can be prevented the brightness of the lamp 10 from decreasing as the thickness of catalytic layer 3 is thinner than that of prior arts.

As photo catalytic layer 3 also prevents dust, nicotine or oil stains from accumulating on envelope 11, it can prevent the reduction of its brightness.

Figure 5:
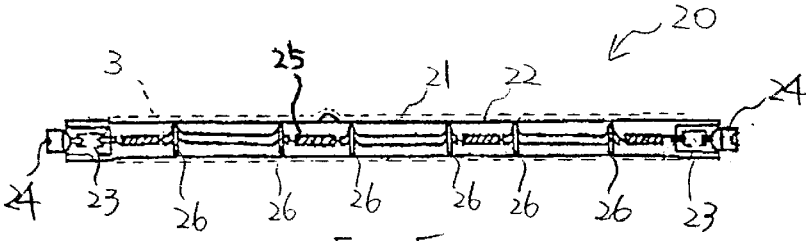
FIG. 5 is an elevation view of an incandescent lamp according to third embodiment of the present invention.

FIG. 5 shows a tubular incandescent lamp 20 according to third embodiment of the present invention.

A silica glass envelope 21 of incandescent lamp 20 is continuously formed with a cylindrical portion 22 and sealed portions 23 at each ends. Each sealed portion 23 is attached a base 24. A filament 25 is provided along the central axis of envelope 21, which is supported by support ring 26 contacting to the inner surface of envelope 21. A photo catalytic layer 3 shown as a dot line is coated on an outer surface of envelope 21 so as to have a thickness of 0.01 to 0.3 microns, which is anatase form of titanium oxide ($TiO_2$).

Figure 6:
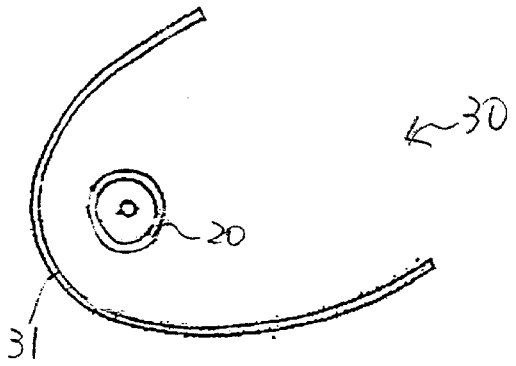
FIG. 6 is a sectional schematic illustration of a lighting fixture according to fourth embodiment of the present invention.

Lamp 20 is preferably assembled within reflector unit 30 shown in FIG. 6. Reflector unit 30 is composed with lamp 20 and reflector 31 housing lamp 20. Then, reflector unit 30 is utilized for a scanner unit of plain paper copier and a facsimile machine. According this embodiment, lamp 20 assembled within such machines tends to be covered with dust because the inside of such machine is dusty, however, photo catalytic layer 3 prevents such dust from accumulating envelope 21. As a result, lamp 20 avoids reducing visible luminous flux.

Figure 7:
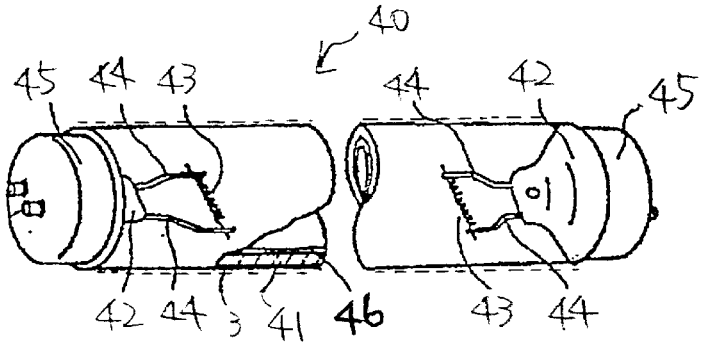
FIG. 7 is a perspective and broken away view of a discharge lamp according to fifth embodiment of the present invention.

FIG. 7 shows a fluorescent lamp 40 according to an embodiment of the present invention. Fluorescent lamp 40 has a rated power of 37 watt, which is defined by Japanese Industrial Standard as FL40SS. An envelope 41 of lamp 40 is constituted by a straight tube having an outer diameter of about 28 mm and stems 42 sealed into each end of the tube in the customary manner. The tube is made of a soda lime glass which will not pass ultraviolet rays under 300 nm in wavelength. As an alternative, other light-transmitting material can be used for tube, such as fused silica, ceramic or borosilicate glass. Each stem 42 supports a pair of electrodes 43 which, during operation, generate a discharge therebetween. Each electrode 43 is formed from a tungsten coiled wire which itself is coiled (double coiled) and employed as a preheating type arrangement. However, other electrode arrangement, such as a cold cathode, an exciting coil for supplying magnetic power to the lamp 40 or an external electrode, may be used. Electrodes 43 are coated with an emitter (not shown), such as BaO, SrO, or CaO, for emitting thermal electrons.

Each stem 42 is provided with an exhaust tube (not shown) that communicates with an opening in the stem wall and has its outer end hermetically sealed after envelope 41 has been evacuated, charged with a discharge sustaining fill, such as mercury vapor, and suitable fill gas in accordance with a standard lamp-manufacturing process. Suitable fill gases are argon, neon, krypton and mixture thereof.

Each electrode 43 is connected to lead wires 44 which are sealed through the inner end of stem 42 and extend into base. Bases 45 are cemented to and enclose ends of envelope 41. Each base 45 is provided with a pair of metal pins that are electrically connected to lead wires 44.

Figure 8:
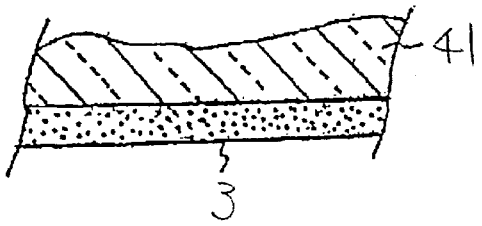
FIG. 8 is a detailed portion cross sectional and broken view of the discharge lamp shown in FIG. 7.

A phosphor layer 46 is coated on the inner surface of envelope 41. Phosphor layer 46 converts ultraviolet rays of 185 nm and 254 nm emitted from a discharge into visible light and ultraviolet radiation in the wavelength range of 320 nm to 410 nm. Phosphor layer 46 is preferably made of a mixture of four luminescent compounds having peak emissions near 610 nm (red light), 540 nm (green light), 450 nm (blue light) and 370 nm (ultraviolet light), respectively. The luminescent compound emitting red, blue and green are yttrium oxide activated by divalent europium indicated as $Y_2O_3:Eu^{3+}$, barium magnesium aluminate activated by divalent europium indicated as $BaMg_2Al_{16}O_{27}:Eu^{2+}$ and lanthanum ceriumphosphate activated by trivalent terbium indicated as $(La,Ce,Tb)PO_4:Tb^{3+}$, respectively. The luminescent compound emitting ultraviolet radiation is strontia boron oxide activated by divalent europium indicated as $SrB_4O_7:Eu^{2+}$ which has a peak emission at 368 nm. The mixing ratio of the ultraviolet luminescent compound to all of the compounds is selected to be between 1 and 10 percent by weight. Although in the present embodiment, the ultraviolet luminescent compound is selected to be $SrB_4O_7:Eu^{2+}$, other luminescent compounds may be used. It is preferable to select from the group consisting of alkaline earth metal borate activated by europium, alkaline earth metal silicate activated by lead, alkaline earth metal phosphate activated by europium and rare earth metal phosphate activated by cerium. For instant, those compounds are indicated as $SrB_4O_7:Eu^{2+}$, $(Ba,Sr,Mg)_3Si_2O_7:Pb^{2+}$, $BaSi_2O_5:Pb^{2+}$, $(SrMg)_2P_2O_7:Eu^{2+}$ and $YPO_4:Ce^{3+}$. Furthermore, it is preferably to add halogen to the compound made of alkaline earth metal borate activated by europium in order to intensify its luminous flux. Further, the spectrum of $Ce^{3+}$, including a green luminescent compound indicated as $(La,Ce,Tb)PO_4:Tb^{3+}$, has ultraviolet radiation in the wavelength range of 320 nm to 410 nm, it is also possible to intensify the ultraviolet radiation by increasing the amount of cerium. As shown in FIG. 8, a photo catalytic layer 3 having 0.1 microns thickness is coated on an outer surface of envelope 41. It is preferable that a thin silica layer (not shown) is coated between the outer surface of envelope 41 and photo catalytic layer 3 to maintain an effective catalytic reaction, because sodium ingredient of soda lime glass tends to move into catalytic layer 3.

Figure 9:
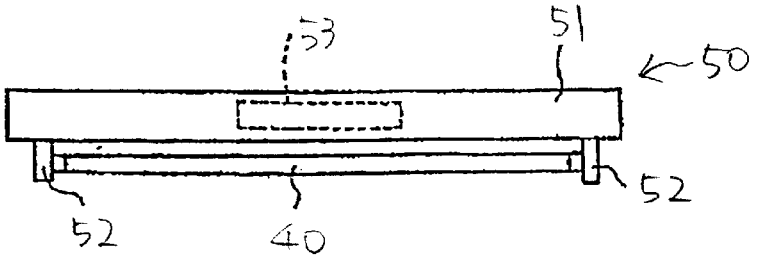
FIG. 9 is a side elevation view of a lighting apparatus using the discharge lamp shown in FIG. 7.

FIG. 9 shows a lighting apparatus 50. Lamp 40 is attached to a luminaire 51 through sockets 52. Luminaire 51 houses an operating circuit 53 for supplying electric power to lamp 40. Operating circuit 53 can be a conventional high frequency inverter circuit or a conventional ballast arrangement, or some equivalent thereof.

As operating circuit 53 generates a lamp current which flows through lamp 40, the discharge generated between a pair of electrodes 43 is extinguished according to the lamp current. The discharge excites mercury vapor which emits ultraviolet rays at wavelengths of 185 nm and 254 nm. The ultraviolet rays are converted into visible light and ultraviolet radiation having a peak at 368 nm by phosphor layer 46 coated on inner surface of envelope 41, then visible light and ultraviolet radiation are radiated through envelope 41. As photo catalytic layer 3 is coated on outer surface of envelope 41, it is excited by the ultraviolet radiation. Electron and hole mobilization occurs in photo catalytic layer 3 and, holes move on its surface. Materials attached on the surface of photo catalytic layer 3, such as sulfur compounds, nitrogen compounds, aldehydes and so on, are decomposed by a catalysis reaction of photo catalytic layer 3.

Figure 10:
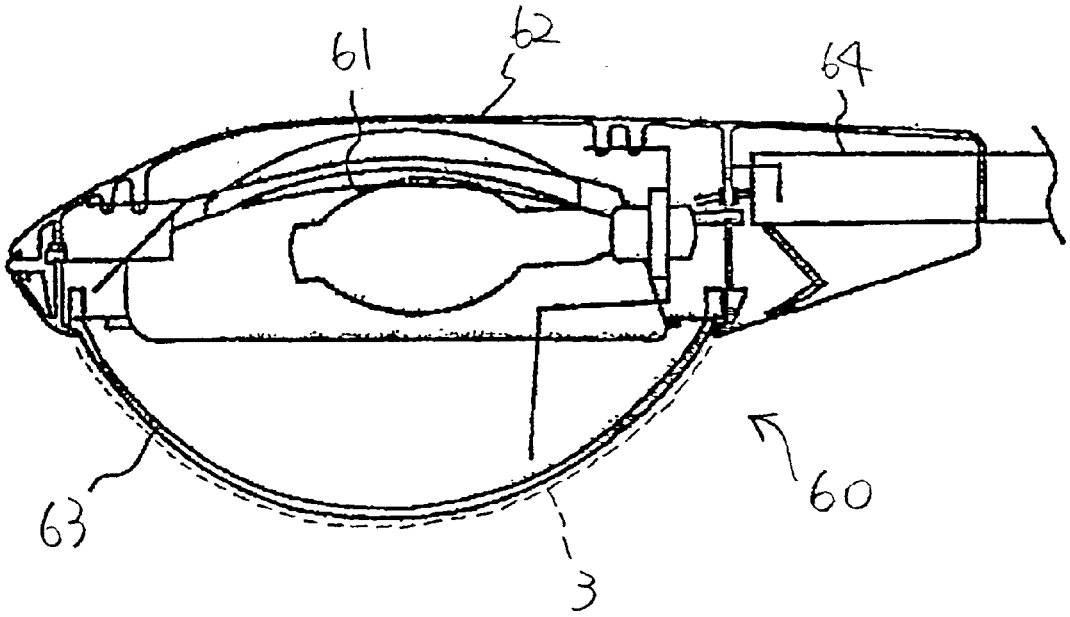
FIG. 10 is a cross sectional view of a lighting apparatus according to sixth embodiment of the present invention.

FIG. 10 shows a lighting apparatus 60 as a road lighting lantern according to an embodiment of the present invention. Lamp 61 is a high intensity discharge lamp such as a high pressure mercury vapor discharge lamp. A luminaire 62 housing lamp 61 has a glass globe 63 so as to transmit the light radiated by lamp 61 and a pole 64 supported by the ground at its end. Photo catalytic layer 3 is coated on an outer surface of globe 63. An operating circuit (not shown) for supplying electric power to lamp 61 is enclosed in pole 64.

As it is known that conventional high pressure mercury vapor discharge lamps have strong ultraviolet radiation around 365 nm and 410 nm in wavelength, catalytic layer 3 coated on outer surface of globe 63 is sufficiently excited by the ultraviolet radiation. Materials attached on the surface of photo catalytic layer 3 are decomposed by a catalysis reaction of photo catalytic layer 3. Accordingly, photo catalytic layer 3 prevents dust, based on exhaust gas and so on, from accumulating globe 63. As a result, lighting apparatus 60 avoids reducing desirable luminous flux.

While the invention has been described in connection with what are presently considered to be the most practical and preferred embodiments, it is to be understood that the invention is not limited to the disclosed embodiments. On the contrary, it is intended to cover various modifications and equivalent arrangements included within the sprit and scope of the appended claims.

What is claimed is:

1. A lighting apparatus comprising:

a luminaire having a light-transmitting portion;

a light source housed in the luminaire, the light source radiating ultraviolet rays having a wavelength below 410 nm;

a photo catalytic layer provided on an outer surface of the light-transmitting portion, the photo catalytic layer substantially including anatase form of titanium oxide and having a thickness of 0.01 to 0.3 microns; and wherein the light source is housed in the luminaire so that the light source irradiates an inner surface of the light-transmitting portion and the catalytic layer receives the ultraviolet rays having at least 0.01 $mW/cm^2$ intensity through the light-transmitting portion.

2. A lighting apparatus according to claim 1, wherein the catalytic layer has a thickness of 0.01 to 0.1 microns.

* * * * *